US012534971B1

(12) United States Patent
Frankland et al.

(10) Patent No.: US 12,534,971 B1
(45) Date of Patent: Jan. 27, 2026

(54) FISHING PROTECTION STRUCTURE

(71) Applicant: OneSubsea IP UK Limited, London (GB)

(72) Inventors: Jonathan Mark Frankland, Leeds (GB); Ryan Lepecha, Leeds (GB); Andrew Speed, Leeds (GB); Ryan Stringwell, Leeds (GB)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 19/018,314

(22) Filed: Jan. 13, 2025

(51) Int. Cl.
*E21B 33/037* (2006.01)

(52) U.S. Cl.
CPC ..... *E21B 33/037* (2013.01)

(58) Field of Classification Search
CPC ..... E21B 33/037; E21B 33/35; F17D 5/00; E02D 7/24; E02D 31/00; E02D 29/12; E02B 17/02
USPC ..... 166/368
See application file for complete search history.

(56) References Cited

U.S. PATENT DOCUMENTS 3,543,846 A * 12/1970 Brun ..... E21B 33/037 166/356
3,913,669 A * 10/1975 Brun ..... E21B 33/038 166/360
4,273,472 A * 6/1981 Piazza ..... E21B 33/037 166/356
5,810,515 A * 9/1998 Fredriksen ..... E21B 43/0175 166/356
9,353,889 B2 * 5/2016 Hunter ..... E21B 41/08
2003/0141077 A1 * 7/2003 Crain ..... E21B 33/037 166/368
2012/0037378 A1 * 2/2012 Fenton ..... E21B 33/037 166/360
2014/0060847 A1 * 3/2014 Sunde ..... B63C 11/52 166/335

FOREIGN PATENT DOCUMENTS

EP 2628892 A1 8/2013
NO 341933 B1 2/2018

OTHER PUBLICATIONS

Zamet SA, "Factory Acceptance Test", https://www.youtube.com/watchv=29qs1WOEIG0, Jun. 25, 2020, 2 pages.
Zamet SA, "Załadunek konstrukcji", https://www.youtube.com/watchy=VJNEi-ag0xA, May 6, 2019, 2 pages.
(Continued)

*Primary Examiner* — Nicole Coy
*Assistant Examiner* — Douglas S Wood
(74) *Attorney, Agent, or Firm* — Jeffrey D. Frantz

(57) ABSTRACT

A fishing protection structure includes a canopy extending to a plurality of outriggers. Each outrigger includes a leg including a hinge connection having a rotational axis. A cover is at the hinge connection. The cover includes a curve in a plane parallel to the longitudinal axis. The curve has a profile substantially in the form of an arc of a circle centered at the rotational axis. A shroud extends along the leg from the cover towards a beak that is configured to contact a seabed.

18 Claims, 6 Drawing Sheets

(56) References Cited

OTHER PUBLICATIONS

Zamet SA, "Nocny wyjazd PGB / PGB Departure by night", https://www.youtube.com/watchy=W5uVEi7Rval, May 10, 2021, 2 pages.
DeepOcean Group, "Autonomous Inspection Drone (AID) ready for offshore operations", https://www.youtube.com/watchy=bgxZsQk-IsE, May 16, 2023, 2 pages.
TechnipFMC, "iEPCI Satellite", https://youtu.be/z9HsZAhuUHUsi=8gf9UyDUtPIrQkTa t=94, Mar. 30, 2018, 2 pages.
Compocean, http://www.compocean.com/products/protection-structures, 2 pages.
Norplast, https://www.norplast.lv/services/oil-gas/, 4 pages.
NOV, "Fiber Glass Systems", https://pipexltd.com/products/subsea-cocoon-shroud-protection-system/, 15 pages.
TechniFMC, "15 years of TechnipFMCs Enhanced Vertical Deep-water Tree", https://youtu.be/4AnKwxNIGg8si=kx4Dv4RDF5wV7ntN t=93, Oct. 17, 2023, 2 pages.

* cited by examiner

FIG. 5B1

FISHING PROTECTION STRUCTURE

BACKGROUND

Many subsea installations, such as wellheads, trees, manifolds, flowlines, and the like are located in areas of commercial fishing activity. The fishing equipment used by fishing vessels typically includes various nets (e.g., trawl nets) and ancillary equipment, such as roller clump weights, trawl doors, warp lines, and the like. The fishing equipment can impact and damage the subsea installations. Additionally, the fishing equipment can become snagged, stuck, or damaged by the subsea installations. Typically, operators of subsea installations install protection structures over installations such as subsea trees. The protection structures are intended to deflect fishing equipment over or around the subsea installations. Nevertheless, the protection structures themselves present a hazard to the fishing equipment, which can become snagged, stuck, or damaged by the protection structures.

There is a need for fishing protection structures to protect subsea installations from damage by fishing equipment while also protecting fishing equipment from becoming snagged, stuck, or damaged by the subsea installations and by the fishing protection structures.

SUMMARY

Aspects of the present disclosure provide fishing protection structures for protecting subsea installations from damage by fishing equipment. The subsea installations include subsea wellheads. The fishing protection structures disclosed herein facilitate protection of the subsea installations while also hindering the fishing equipment from becoming snagged, stuck, or damaged by the subsea installations or by the fishing protection structures.

In one aspect, a fishing protection structure includes a plurality of outriggers. Each outrigger includes a leg having a longitudinal axis. The leg extends from a first end to a second end. A hinge connection is at the first end. The hinge connection includes a rotational axis. A cover is at the hinge connection. The cover includes a curve in a plane parallel to the longitudinal axis. The curve has a profile substantially in the form of an arc of a circle centered at the rotational axis. A shroud extends along the leg from the cover towards the second end.

In another aspect, an assembly includes a plurality of outriggers coupled to a guide base. Each outrigger includes a leg having a longitudinal axis. The leg extends from a first end to a second end. A coupling between the first end and the guide base includes a hinge having a rotational axis. A cover is at the hinge. The leg and the cover are pivotable with respect to the guide base about the rotational axis. A canopy is coupled to the guide base and extends to each hinge. A guard plate is coupled to the guide base below the canopy and between two outriggers of the plurality of outriggers.

In another aspect, a fishing protection structure includes a plurality of outriggers. Each outrigger includes a leg having a longitudinal axis. The leg extends from a first end to a second end. A hinge connection is at the first end. The hinge connection includes a rotational axis. A cover is at the hinge connection. The cover includes a curve in a plane parallel to the longitudinal axis. The curve has a profile substantially in the form of an arc of a circle centered at the rotational axis. A canopy extends to the hinge connection of each outrigger and includes a corresponding lip at each hinge connection over a portion of each cover.

The following description and the appended figures set forth certain features for purposes of illustration.

BRIEF DESCRIPTION OF DRAWINGS

The appended figures illustrate only exemplary embodiments and are therefore not to be considered limiting of the scope of the disclosure, as the disclosure may admit to other equally effective embodiments. The features depicted in the figures are not necessarily shown to scale. Certain features of the embodiments may be shown exaggerated in scale or in somewhat schematic form, and some details of elements may not be shown in the interest of clarity and conciseness. These and other features, aspects, and advantages of the present invention will become better understood when the following detailed description is read with reference to the accompanying drawings in which like characters represent like parts throughout the drawings, wherein:

FIGS. 5A, 5A1, 5B, and 5B1 schematically illustrate a portion of the fishing protection structure of FIG. 1 in different positions according to one or more aspects of the present disclosure.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Aspects of the present disclosure provide systems and apparatus for protecting subsea installations from damage by fishing equipment (such as trawl nets (such as beam trawls), roller clump weights, trawl doors, warp lines, etc.). The subsea installations include subsea wellheads, subsea trees, and the like. The systems and apparatus disclosed herein facilitate protection of the subsea installations while also deterring the fishing equipment from becoming snagged, stuck, or damaged by the subsea installations. The systems and apparatus disclosed herein include protective structures that deter the fishing equipment from becoming snagged, stuck, or damaged by the protective structures themselves.

Figure 1:
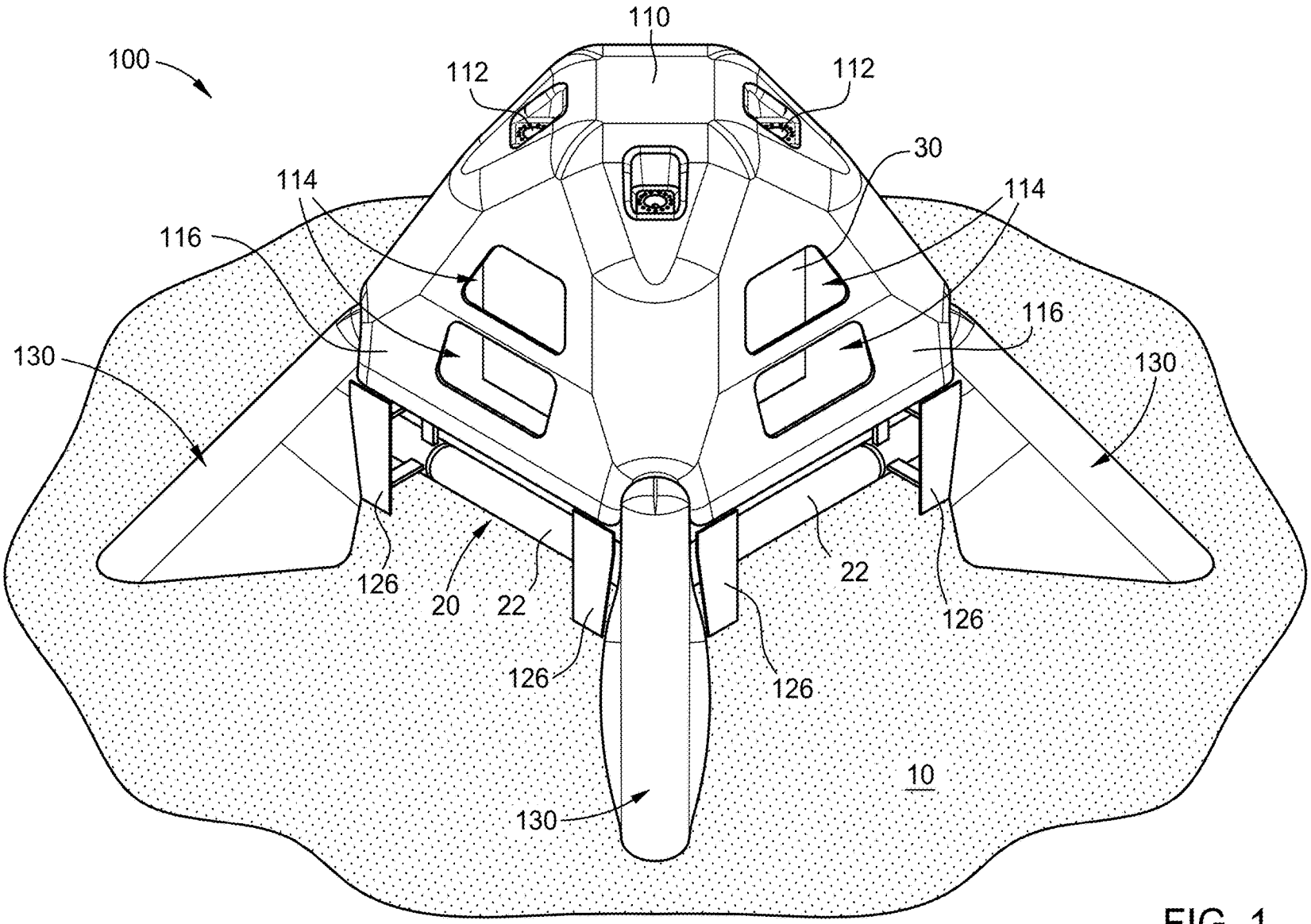
FIG. 1 schematically illustrates a fishing protection structure according to one or more aspects of the present disclosure.

FIG. 1 schematically illustrates a fishing protection structure 100. The fishing protection structure 100 is shown installed at a seabed 10, coupled to a guide base 20, such as production guide base. The fishing protection structure 100 includes a canopy 110 and a plurality of outriggers 130. As illustrated, in some embodiments, the canopy 110 is generally dome-shaped. In some embodiments, the canopy 110 includes one or more connecting points 112 that facilitate connection to the guide base 20, such as by bolts. The canopy 110 is shown enclosing a subsea tree 30 that is coupled to the guide base 20. In some embodiments, the canopy 110 includes one or more windows 114 that facilitate access to the subsea tree 30 and/or to the guide base 20, such as for visual inspection or for operation, such as by a remotely operated vehicle (commonly referred to as an "ROV").

In some embodiments, a skirt 116 of the canopy 110 extends to a base frame 22 of the guide base 20. In some embodiments, the skirt 116 extends to one or more guard plates 126. In some embodiments, the one or more guard plates 126 are oriented substantially vertically, such as within two degrees of a vertical orientation with respect to a nominal position of the guide base 20 at the seabed 10. In some embodiments, the one or more guard plates 126 are oriented at an acute angle with respect to a nominal position of the guide base 20 at the seabed 10. In some embodiments, the one or more guard plates 126 are coupled to the guide base 20. In an example, the one or more guard plates 126 are coupled to the base frame 22 of the guide base 20. In some embodiments, the one or more guard plates 126 are coupled to the canopy 110. In an example, the one or more guard plates 126 are attached to the canopy 110, such as by bolts. In another example, the one or more guard plates 126 are integral with the canopy 110.

The canopy 110 extends to each outrigger. The fishing protection structure 100 may include three or more outriggers 130, such as four outriggers 130, five outriggers 130, or six or more outriggers 130. In the illustrated example, the fishing protection structure 100 includes four outriggers 130, of which three outriggers 130 are visible in the Figure. As illustrated, in some embodiments, the outriggers 130 are disposed at corners of the guide base 20. In some embodiments, one or more outriggers 130 are disposed along a side of the guide base 20.

In some embodiments, the one or more guard plates 126 are disposed adjacent one or more of the outriggers 130. In some embodiments, the one or more guard plates 126 extend substantially an entire distance from one outrigger to another outrigger. As illustrated, in some embodiments, the one or more guard plates 126 do not extend substantially an entire distance from one outrigger to another outrigger.

In some embodiments, the canopy 110 is made from a metal, such as steel. In some embodiments, the canopy 110 is made from a composite material, such as a glass fiber reinforced polymer or a steel-impregnated glass fiber reinforced polymer. In some examples, the canopy 110 is made from glass fiber reinforced polyester or steel-impregnated glass fiber reinforced polyester. In some embodiments, the one or more guard plates 126 are made from a metal, such as steel. In some embodiments, the one or more guard plates 126 are made from a composite material, such as a glass fiber reinforced polymer or a steel-impregnated glass fiber reinforced polymer. In some examples, the one or more guard plates 126 are made from glass fiber reinforced polyester or steel-impregnated glass fiber reinforced polyester.

In some embodiments, the outriggers 130 and the canopy 110 are coupled to the guide base 20 prior to running the guide base 20 and installing the guide base 20 at a subsea location. In some embodiments, the outriggers 130 are coupled to the guide base 20, but the canopy 110 is not coupled to the guide base 20 prior to running the guide base 20 and installing the guide base 20 at a subsea location. In such embodiments, the guide base 20 with the outriggers 130 is installed at a subsea location, and then the canopy 110 is run and coupled to the guide base 20. In an example, the subsea tree 30 is installed after deploying the guide base 20 (with the outriggers 130), and before installing the canopy 110 onto the guide base 20.

Figure 2B:
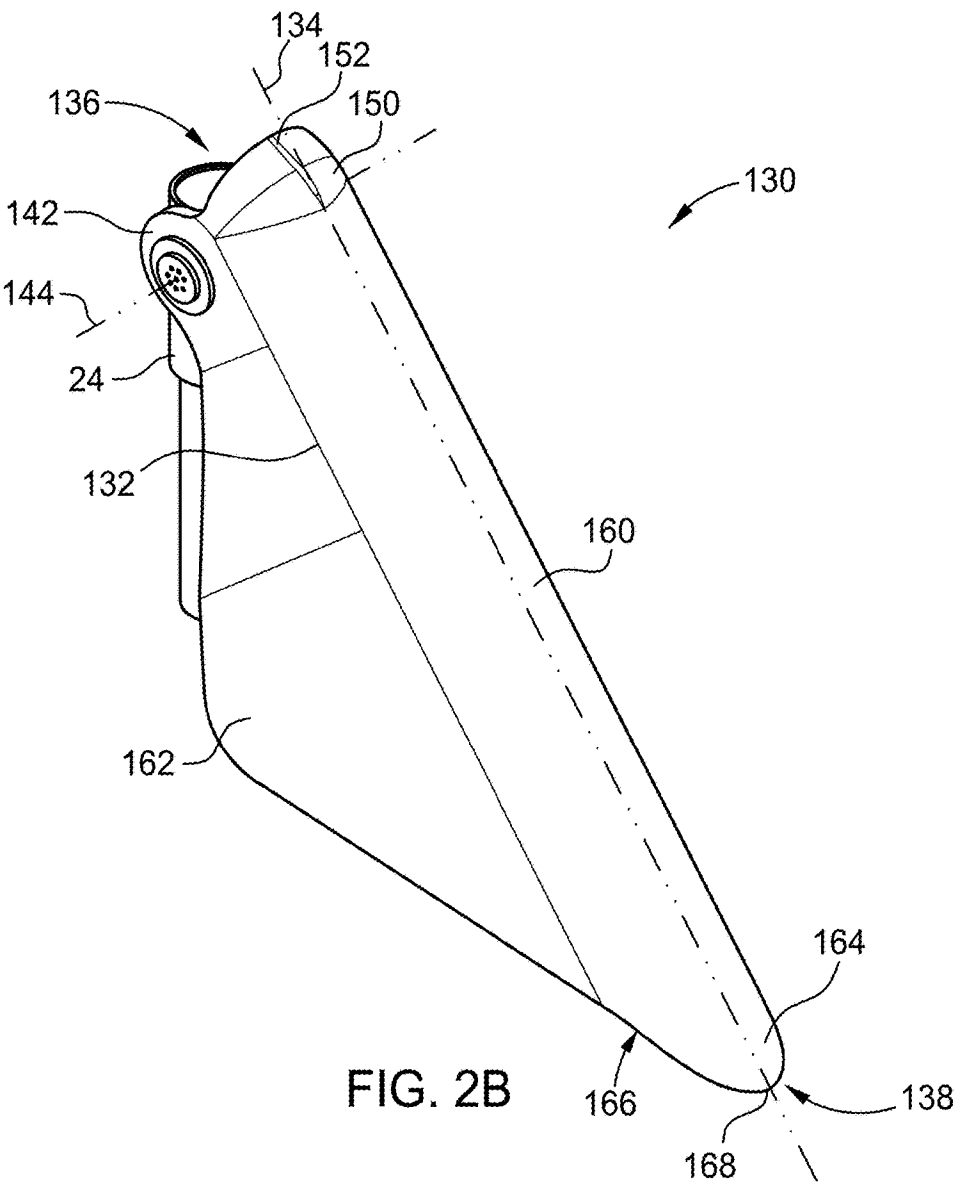
FIGS. 2A and 2B schematically illustrate a portion of the fishing protection structure of FIG. 1 according to one or more aspects of the present disclosure.
Figure 2A:
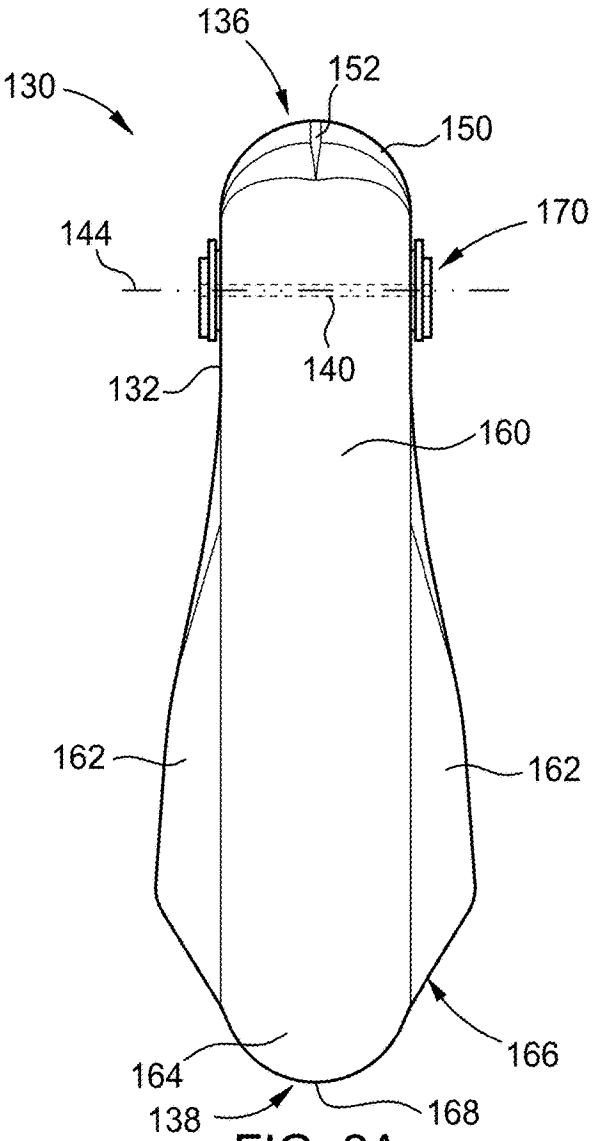

FIGS. 2A and 2B schematically illustrate an outrigger 130 in further detail. The outrigger 130 includes a leg 132 having a longitudinal axis 134. The leg 132 extends along the longitudinal axis 134 from a first end 136 to a second end 138. A hinge connection 142 at the first end 136 facilitates coupling of the leg 132 to a stanchion 24 via a hinge 140. In some embodiments, the stanchion 24 is coupled to the guide base 20, such as by welding. In some embodiments, the stanchion 24 forms part of the guide base 20. A coupling between the first end 136 of the leg 132 and the guide base 20 includes the hinge 140. The hinge 140 and hinge connection 142 have a rotational axis 144. In some embodiments, the rotational axis 144 is perpendicular to the longitudinal axis 134.

A cover 150 at the hinge connection 142 includes a curve 152 in a plane parallel to the longitudinal axis 134. In some embodiments, the curve 152 has a profile substantially in the form of an arc of a circle centered at the rotational axis 144. As illustrated, in some embodiments, the cover 150 is curved in a plane parallel to the rotational axis 144 of the hinge 140. In an example, the curvature of the cover 150 in the plane parallel to the rotational axis 144 of the hinge 140 has a radius substantially the same as the radius of the curve 152. In such an example, the cover 150 is in the form of a portion of a sphere. In some embodiments, when the leg 132 is attached to the stanchion 24, the cover 150 extends over at least a portion of the stanchion 24.

A shroud 160 extends along the leg 132 from the cover 150 towards the second end 138. In some embodiments, the shroud 160 includes a profile in the plane parallel to the rotational axis 144 of the hinge 140 that is substantially similar to the curvature of the cover 150 in the plane parallel to the rotational axis 144 of the hinge 140. In an example, the shroud 160 includes a semi-circular profile. In some embodiments, the cover 150 is integral with the shroud 160. In some embodiments, the shroud 160 extends to a beak 164 at the second end 138. In some embodiments, the beak 164 is integral with the shroud 160. The beak 164 is configured to contact the seabed 10. In some embodiments, the beak 164 includes a profile 166. In some embodiments, the profile 166 includes a curve that transitions towards a tip 168 of the beak 164 that is configured to penetrate the surface of the seabed 10. In the illustrated example, the curve is at an underside of the beak 164. In some embodiments, the tip is in line with the longitudinal axis 134. In some embodiments, the tip 168 points away from the longitudinal axis 134. In some embodiments, the shroud 160 extends in a direction perpendicular to the longitudinal axis 134. In the illustrated example, the shroud 160 includes a flared portion 162 extending away from the leg 132.

In some embodiments, the shroud 160 is made from a metal, such as steel. In some embodiments, the shroud 160 is made from a composite material, such as a glass fiber reinforced polymer or a steel-impregnated glass fiber reinforced polymer. In some examples, the shroud 160 is made from glass fiber reinforced polyester or steel-impregnated glass fiber reinforced polyester.

In some embodiments, the cover 150 is made from a metal, such as steel. In some embodiments, the cover 150 is made from a composite material, such as a glass fiber reinforced polymer or a steel-impregnated glass fiber reinforced polymer. In some examples, the cover 150 is made from glass fiber reinforced polyester or steel-impregnated glass fiber reinforced polyester.

In some embodiments, the beak 164 is made from a metal, such as steel. In some embodiments, the beak 164 is made from a composite material, such as a glass fiber reinforced polymer or a steel-impregnated glass fiber reinforced polymer. In some examples, the beak 164 is made from glass fiber reinforced polyester or steel-impregnated glass fiber reinforced polyester. In some embodiments, the beak 164 is made from a first material (such as a composite material), and the tip 168 includes a second material (such as a metallic cap over the first material).

In some embodiments, at least one outrigger 130 of the fishing protection structure 100 includes a scouring indicator 170. In some embodiments, the scouring indicator is omitted from at least one outrigger 130.

Figure 3:
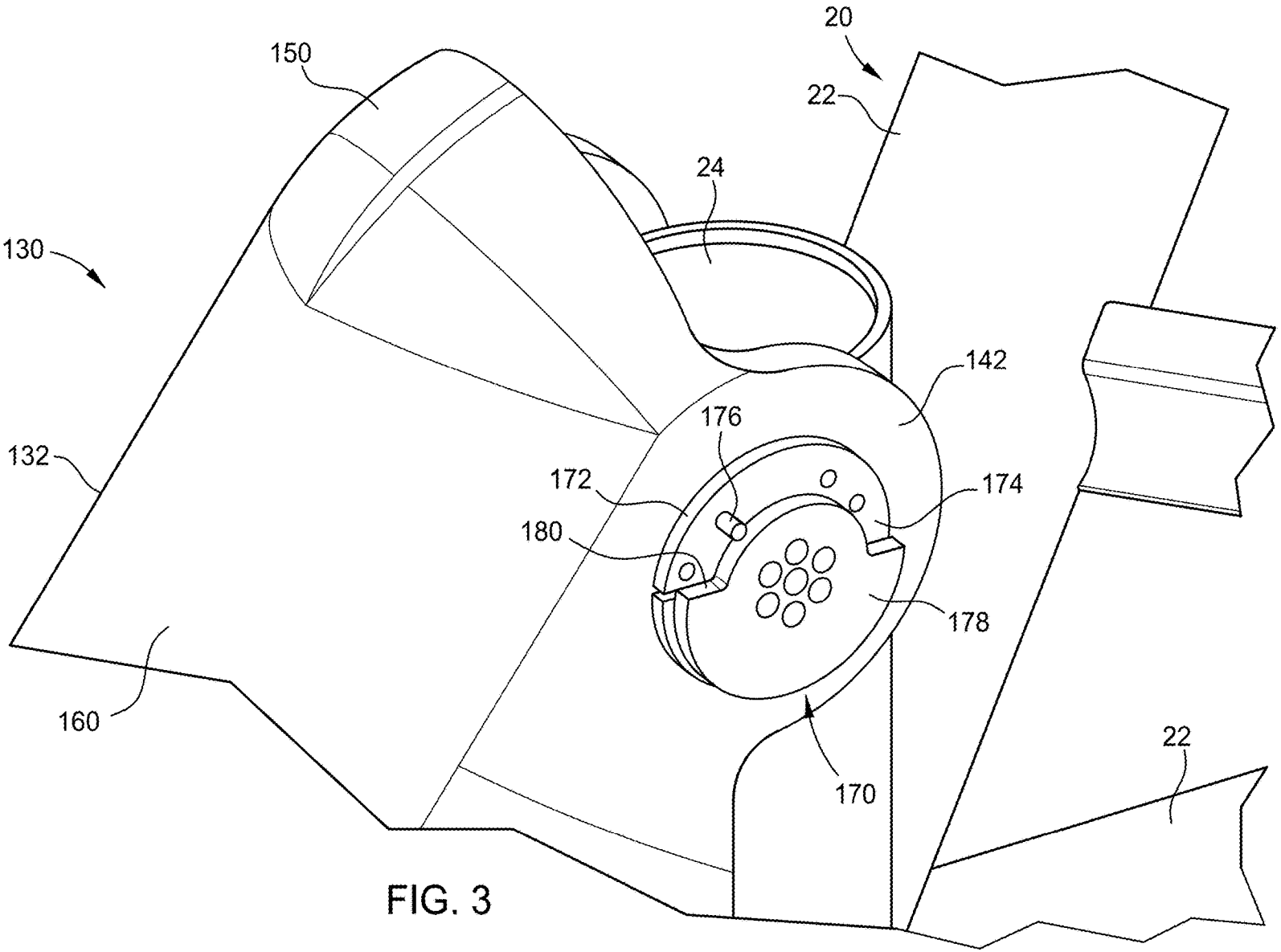
FIG. 3 schematically illustrates an exemplary aspect of a portion of the fishing protection structure of FIG. 1 according to one or more aspects of the present disclosure.

FIG. 3 schematically illustrates an exemplary scouring indicator 170. The leg 132 of the outrigger 130 is attached to the stanchion 24 as described above. Other items of the fishing protection structure 100, such as the canopy 110 and the guard plates 126, are omitted from the Figure for clarity. The scouring indicator 170 is located at the hinge connection 142.

The scouring indicator 170 includes a first portion 172 (e.g., a disc 174) that is coupled to the cover 150, such as by bolts. The first portion 172 moves with the cover 150 as the leg 132 pivots about the hinge 140 with respect to the stanchion 24.

The scouring indicator 170 includes a second portion 178 external to the first portion 172. The second portion 178 is shaped and sized to overlie part of the first portion 172. The second portion 178 is coupled to the stanchion 24, such as by bolts that pass through a void in the first portion 172. The second portion 178 remains stationary with respect to the stanchion 24 while the first portion 172 pivots about the hinge 140.

The first portion 172 includes an indicator pin 176 that protrudes from the disc. The second portion 178 includes a stop surface 180. The rotational position of the indicator pin 176 with respect to the stop surface 180 provides an indication of the angle of the longitudinal axis 134 of the leg 132 of the outrigger 130 with respect to horizontal. In some embodiments, a sensor (e.g., a Hall effect sensor) detects the position of the indicator pin 176 with respect to the stop surface 180, and provides a corresponding signal that is relayed to an operator. In some embodiments, the position of the indicator pin 176 with respect to the stop surface 180 is observed by a camera on an ROV.

In an exemplary deployment of the fishing protection structure 100, each outrigger 130 is pivoted about the corresponding hinge 140, and the beak 164 contacts the seabed 10. In some embodiments, the beak 164 penetrates into the seabed 10. Over time, fishing activity or local currents may cause the seabed 10 to become eroded away (referred to as "scouring") at one or more outriggers 130. Each beak 164 of the corresponding outrigger 130 moves downwards as the seabed 10 is scoured, and the leg 132 pivots downwards about the hinge 140. As the leg 132 pivots downwards, the first portion 172 of the scouring indicator 170 rotates while the second portion 178 remains rotationally stationary. The indicator pin 176 moves towards the stop surface 180.

In some jurisdictions, the regulatory authorities stipulate a maximum permitted angle of the leg 132 of an outrigger 130 with respect to horizontal. Monitoring of the indicator pin 176 with respect to the stop surface 180 facilitates the initiation of remedial action if the leg 132 of an outrigger 130 approaches the maximum permitted angle with respect to horizontal. In some embodiments, the stop surface 180 is positioned such that the indicator pin 176 contacts the stop surface 180 if the leg 132 of the outrigger 130 approaches the maximum permitted angle with respect to horizontal to within a tolerance margin, such as within one degree, within two degrees, or within three degrees. In some embodiments, the stop surface 180 is positioned such that the indicator pin 176 contacts the stop surface 180 if the leg 132 of the outrigger 130 reaches the maximum permitted angle with respect to horizontal.

Figure 4:
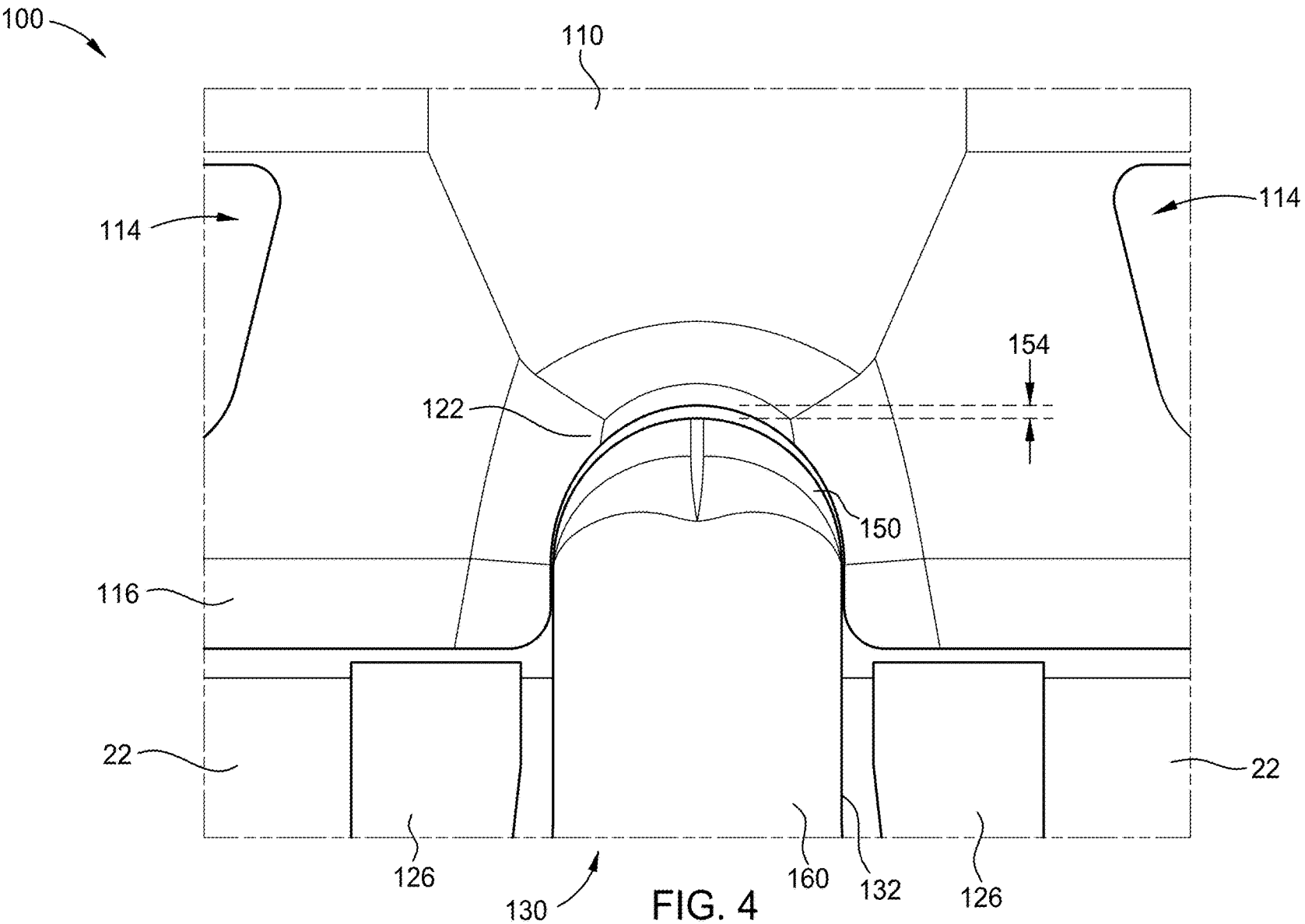
FIG. 4 schematically illustrates a portion of the fishing protection structure of FIG. 1 according to one or more aspects of the present disclosure.

FIG. 4 schematically illustrates an exemplary interface between the canopy 110 and an outrigger 130. As illustrated, in some embodiments, the canopy 110 includes a lip 122 at each outrigger 130. Each lip 122 at least partially surrounds a portion of the first end 136 of a corresponding leg 132 of an outrigger 130. In some embodiments, each lip 122 at least partially surrounds a portion of the cover 150 of a corresponding outrigger 130. In the illustrated embodiment, the cover 150 is curved in a plane parallel to the rotational axis 144 of the hinge 140, such as described above. As illustrated, in some embodiments, the lip 122 is curved around the cover 150 in a plane parallel to the rotational axis 144 of the hinge 140. A gap 154 between the lip 122 and the cover 150 facilitates the pivoting of the leg 132 of the outrigger 130 about the hinge 140.

Figure 5A:
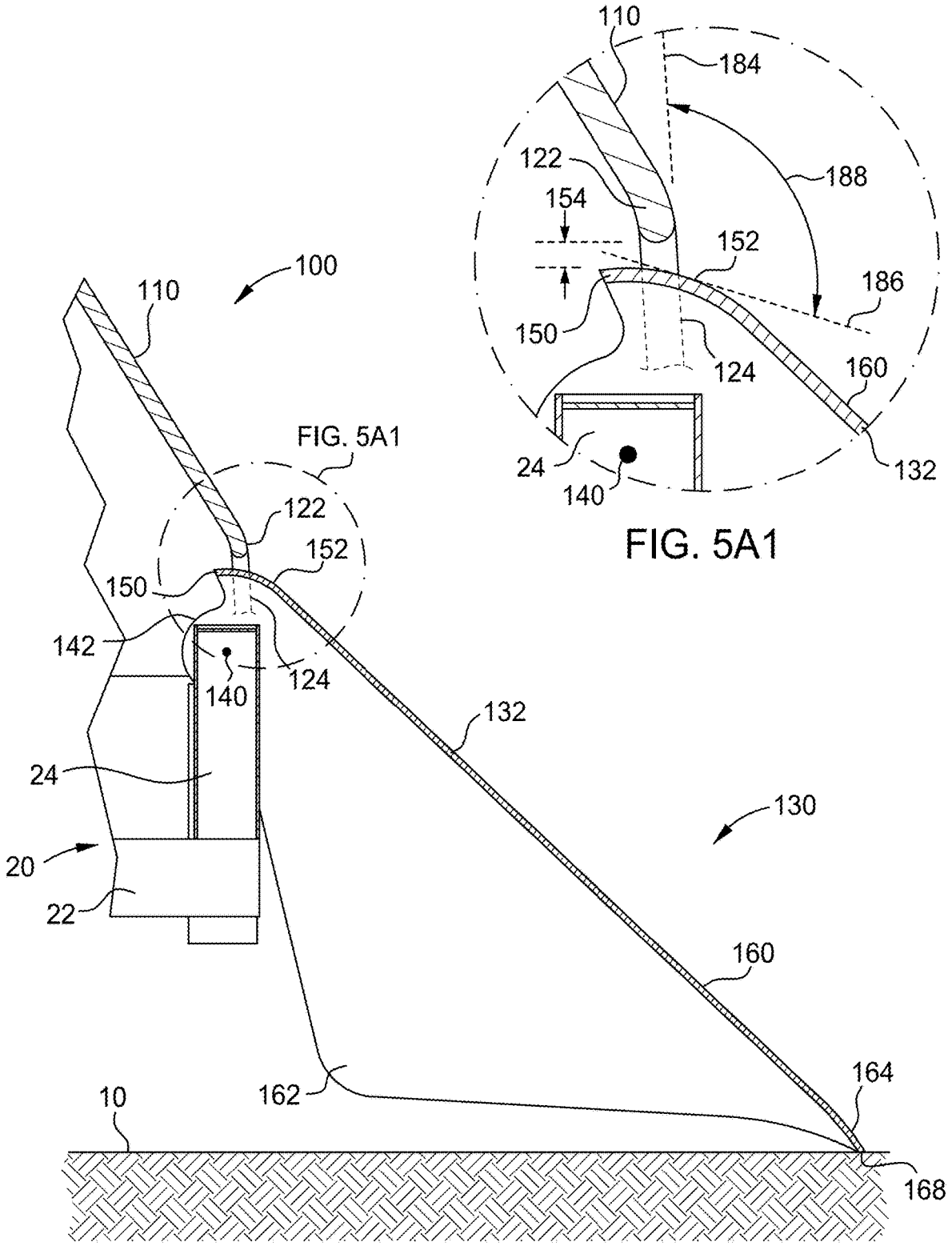
Figure 5B:
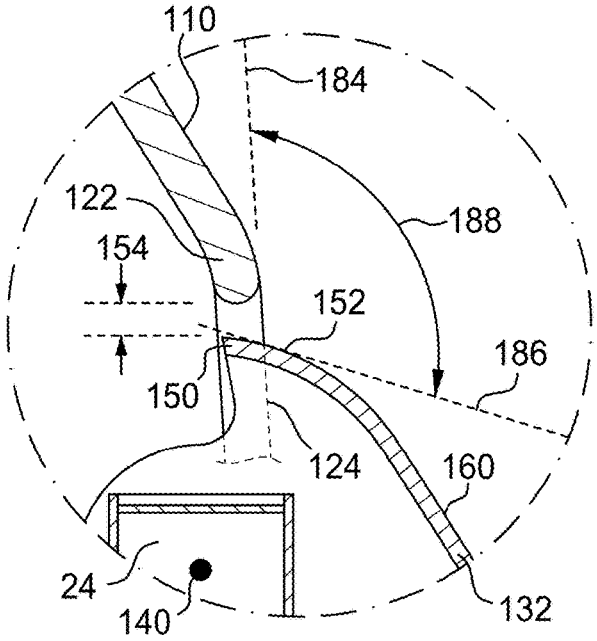
Figure 5B:
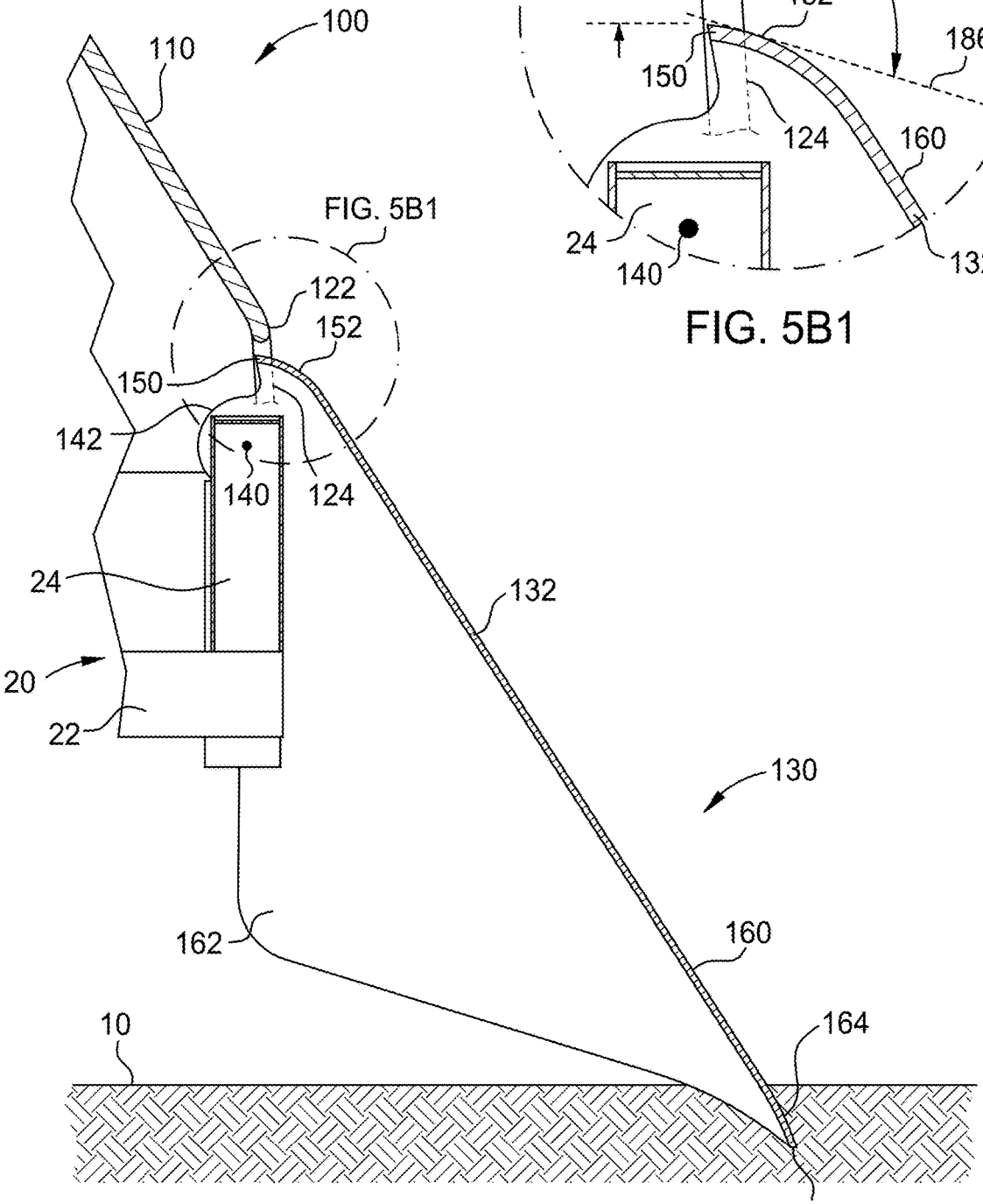

FIGS. 5A, 5A1, 5B, and 5B1 schematically illustrate, in cross-section, the pivoting of the leg 132 of the outrigger 130 about the hinge 140 while the fishing protection structure 100 is in use, having been deployed on the seabed 10. FIGS. 5A and 5A1 depict the leg 132 in a raised position; FIGS. 5B and 5B1 depict the leg 132 in a lowered position. FIG. 5A1 is an enlargement of a portion of FIG. 5A; FIG. 5B1 is an enlargement of a portion of FIG. 5B.

In FIG. 5A, the tip 168 of the beak 164 is shown touching the surface of the seabed 10. In some embodiments, the tip 168 is embedded in the seabed 10. As illustrated, in some embodiments, the flared portion 162 of the shroud 160 extends towards the seabed 10, but does not touch the seabed 10. However, in some embodiments, the flared portion 162 touches the seabed 10.

FIG. 5B represents a scenario in which (for example) scouring of the seabed 10 has occurred. The leg 132 has rotated about the hinge 140 such that the beak 164 has moved downwards. Additionally, the tip 168 of the beak 164 is shown embedded in the seabed 10. In some embodiments, the seabed 10 is subject to scouring, and the tip 168 is touching the surface of the seabed 10.

FIGS. 5A1 and 5B1 depict a plane 184 of a front face 124 of the lip 122. The gap 154 between the cover 150 and the lip 122 is depicted at the intersection of the cover 150 and the lip 122 with the plane 184. The gap 154 between the cover 150 and the lip 122 remains substantially constant as the leg 132 pivots between the raised and lowered positions. In an example, a width of the gap 154 varies by 10% or less, such as 7% or less, 5% or less, 3% or less, 2% or less, or 1% or less.

When the fishing protection structure 100 is in use, maintaining the gap 154 substantially constant as the leg 132 of the outrigger 130 pivots between the raised and lowered positions provides for consistency in the interactions between the fishing protection structure 100 and fishing equipment. In an example, a risk of snagging of a trawl net, a warp line, or a roller clump weight is substantially unchanged whether the leg 132 is at the raised position, the lowered position, or a position therebetween. Furthermore, maintaining the gap 154 substantially constant as the leg 132 pivots between the raised and lowered positions facilitates the juxtaposition of the lip 122 of the canopy 110 and the cover 150 of the outrigger 130 such that the gap 154 is relatively small, such as 2 inches (5 cm) or less, such as 1 inch (2.5 cm) or less. The smaller the gap 154, the lower the risk of fishing equipment becoming snagged at the gap 154.

FIGS. 5A1 and 5B1 depict also a tangent 186 to the curve 152 of the cover 150 that lies in the plane parallel to the longitudinal axis 134 of the leg 132 of the outrigger 130. The tangent 186 touches the curve 152 of the cover 150 where the curve 152 intersects the plane 184 at the front face 124 of the lip 122. An angle 188 is shown between the plane 184 at the front face 124 of the lip 122 and the tangent 186 to the curve 152 of the cover 150. As illustrated, in some embodiments, the angle 188 is an obtuse angle. In some embodiments, the angle 188 is a right angle. In some embodiments, the angle 188 remains substantially constant as the leg 132 pivots between the raised and lowered positions. In an example, a magnitude of the angle 188 varies by 10% or less, such as 7% or less, 5% or less, 3% or less, 2% or less, or 1% or less.

When the fishing protection structure 100 is in use, maintaining the angle 188 substantially constant as the leg 132 of the outrigger 130 pivots between the raised and lowered positions provides for consistency in the interactions between the fishing protection structure 100 and fishing equipment. In an example, a risk of snagging of a trawl net, a warp line, or a roller clump weight is substantially unchanged whether the leg 132 is at the raised position, the lowered position, or a position therebetween. Furthermore, in embodiments in which the angle 188 is obtuse, the fishing protection structure 100 is configured to promote a smooth transition between the outrigger 130 and the canopy 110 such that fishing equipment (e.g., trawl nets, warp lines, or roller clump weights) do not snag when being dragged over the fishing protection structure 100.

During use of the fishing protection structure 100, pivoting of the leg 132 (such as due to scouring of the seabed 10) does not significantly change the configuration of the fishing protection structure 100 that fishing equipment encounters. The fishing protection structures of the present disclosure provide for flexibility in catering for changes in the seabed 10, such as due to scouring, without significantly adversely affecting a risk of snagging or damaging fishing equipment. The behavior of the fishing equipment when the fishing equipment encounters the fishing protection structure 100 is more predictable than for conventional fishing protection structures.

Embodiments of the present disclosure provide systems and apparatus for protecting subsea installations from damage by fishing equipment while also protecting fishing equipment from becoming snagged, stuck, or damaged by the subsea installations.

Embodiments of the present disclosure provide systems and apparatus for protecting fishing equipment from becoming snagged, stuck, or damaged by the disclosed systems and apparatus.

It is contemplated that any one or more elements or features of any one disclosed embodiment or example may be beneficially incorporated in any one or more other non-mutually exclusive embodiments or examples. While the foregoing is directed to embodiments of the present disclosure, other and further embodiments of the disclosure may be devised without departing from the basic scope thereof, and the scope thereof is determined by the claims that follow.

The following claims are not intended to be limited to the aspects shown herein, but are to be accorded the full scope consistent with the language of the claims. Within a claim, reference to an element in the singular is not intended to mean "one and only one" unless specifically so stated, but rather "one or more." Unless specifically stated otherwise, the term "some" refers to one or more. No claim element is to be construed under the provisions of 35 U.S.C. § 112 (f) unless the element is expressly recited using the phrase "means for." All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims.

What is claimed is:

1. A fishing protection structure, comprising:

a plurality of outriggers, each outrigger including:

a leg having a longitudinal axis, and extending from a first end to a second end;

a hinge connection at the first end, the hinge connection including a rotational axis;

a cover at the hinge connection, the cover including a curve in a plane parallel to the longitudinal axis, the curve having a profile substantially in the form of an arc of a circle centered at the rotational axis; and a shroud extending along the leg from the cover towards the second end, wherein at least one outrigger includes a scouring indicator at the hinge connection.

2. The fishing protection structure of claim 1, wherein the shroud extends to a beak at the second end, the beak including a profile configured to penetrate a seabed surface.

3. The fishing protection structure of claim 1, wherein the shroud extends in a direction perpendicular to the longitudinal axis.

4. The fishing protection structure of claim 3, wherein the shroud includes a flared portion extending away from the leg.

5. The fishing protection structure of claim 1, wherein the scouring indicator includes a first portion movable with respect to a second portion, the first portion coupled to the cover.

6. The fishing protection structure of claim 1, further comprising a canopy extending to the hinge connection of each outrigger.

7. The fishing protection structure of claim 6, wherein the canopy includes a corresponding lip at each hinge connection over a portion of each cover.

8. An assembly, comprising:

a plurality of outriggers coupled to a guide base, each outrigger including:

a leg having a longitudinal axis, and extending from a first end to a second end, wherein a coupling between the first end and the guide base includes a hinge having a rotational axis; and a cover at the hinge, wherein the leg and the cover are pivotable with respect to the guide base about the rotational axis;

a canopy coupled to the guide base and extending to each hinge, wherein the canopy includes a corresponding lip at each hinge over a portion of each cover; and a guard plate coupled to the guide base below the canopy and between two outriggers of the plurality of outriggers.

9. The assembly of claim 8, wherein the cover of each outrigger includes a curve in a plane parallel to the longitudinal axis, the curve having a profile substantially in the form of an arc of a circle centered at the rotational axis.

10. The assembly of claim 8, wherein each outrigger includes a shroud extending along the leg from the cover towards the second end.

11. The assembly of claim 10, wherein the shroud includes a flared portion extending away from the leg.

12. The assembly of claim 8, wherein at least one outrigger includes a scouring indicator at the hinge.

13. The assembly of claim 12, wherein the scouring indicator includes a first portion movable with respect to a second portion, the first portion coupled to the cover.

14. A fishing protection structure, comprising:

a plurality of outriggers, each outrigger including:

a leg having a longitudinal axis, and extending from a first end to a second end;

a hinge connection at the first end, the hinge connection including a rotational axis; and a cover at the hinge connection, the cover including a curve in a plane parallel to the longitudinal axis, the curve having a profile substantially in the form of an arc of a circle centered at the rotational axis; and a canopy extending to the hinge connection of each outrigger, and including a corresponding lip at each hinge connection over a portion of each cover.

15. The fishing protection structure of claim 14, wherein each leg is pivotable with respect to the canopy about the rotational axis between raised and lowered positions.

16. The fishing protection structure of claim 15, wherein a gap between each lip of the canopy and the corresponding cover remains substantially constant as the corresponding leg pivots between the raised and lowered positions.

17. The fishing protection structure of claim 14, wherein at least one outrigger of the plurality of outriggers includes a scouring indicator at the hinge connection.

18. The fishing protection structure of claim 17, wherein the scouring indicator includes a first portion movable with respect to a second portion, the first portion coupled to the cover.

* * * * *